US010707015B2

(12) United States Patent
Hashimoto et al.

(10) Patent No.: US 10,707,015 B2
(45) Date of Patent: Jul. 7, 2020

(54) METHOD FOR MANUFACTURING LAMINATED IRON CORE AND APPARATUS FOR MANUFACTURING LAMINATED IRON CORE

(71) Applicants: MITSUI HIGH-TEC, INC., Kitakyushu-shi, Fukuoka (JP); MITSUBISHI ELECTRIC CORPORATION, Tokyo (JP)

(72) Inventors: Akihiro Hashimoto, Fukuoka (JP); Masahiko Furuta, Fukuoka (JP); Toshio Goto, Fukuoka (JP); Yoshihiro Harada, Tokyo (JP); Yoshiro Imazawa, Tokyo (JP)

(73) Assignees: MITSUI HIGH-TEC, INC., Fukuoka (JP); MITSUBISHI ELECTRIC CORPORATION, Tokyo (JP)

( * ) Notice: Subject to any disclaimer, the term of this patent is extended or adjusted under 35 U.S.C. 154(b) by 138 days.

(21) Appl. No.: 15/460,589

(22) Filed: Mar. 16, 2017

(65) Prior Publication Data

US 2017/0278628 A1 Sep. 28, 2017

(30) Foreign Application Priority Data

Mar. 22, 2016 (JP) ..... 2016-057136

(51) Int. Cl.
*H01F 41/02* (2006.01)
*H01F 3/02* (2006.01)
(Continued)

(52) U.S. Cl.
CPC ..... *H01F 41/0213* (2013.01); *H01F 3/02* (2013.01); *H01F 3/04* (2013.01); *H01F 27/26* (2013.01);
(Continued)

(58) Field of Classification Search
CPC ..... H01F 41/0213; H01F 41/0233; H01F 41/0204; H01F 3/02; H01F 3/04;
(Continued)

(56) References Cited

U.S. PATENT DOCUMENTS 1,477,359 A * 12/1923 Johannesen ..... H01F 41/0233 29/609
4,102,040 A * 7/1978 Rich ..... H02K 1/16 29/596
(Continued)

FOREIGN PATENT DOCUMENTS

CN 101523696 9/2009
CN 102077448 5/2011
(Continued)

OTHER PUBLICATIONS

Office Action issued in China Counterpart Patent Appl. No. 201710174144.2, dated Sep. 28, 2018, along with an English translation thereof.
(Continued)

*Primary Examiner* — Peter Dungba Vo
*Assistant Examiner* — Jeffrey T Carley
(74) *Attorney, Agent, or Firm* — Greenblum & Bernstein, P.L.C.

(57) ABSTRACT

A method for manufacturing a laminated iron core includes setting a blanking position on a strip-shaped workpiece for iron core pieces each including a yoke piece part having a linear shape and a magnetic pole piece part extending from the yoke piece part, such that a pair of iron core pieces are opposed each other and the magnetic pole piece part of one iron core piece is arranged between adjacent magnetic pole piece parts of the other iron core piece among the pair of iron core pieces, simultaneously blanking a front end side of the magnetic pole piece part and a back surface side of the yoke
(Continued)

piece part of the one iron core piece from the strip-shaped workpiece before simultaneously blanking those of the other iron core piece from the strip-shaped workpiece, and blanking the iron core pieces from the strip-shaped workpiece.

8 Claims, 5 Drawing Sheets

(51) Int. Cl.

| | |
|---|---|
| ***H01F 27/26*** | (2006.01) |
| ***H01F 3/04*** | (2006.01) |
| *H01F 27/245* | (2006.01) |
| *H01F 3/00* | (2006.01) |
| *H01F 27/25* | (2006.01) |

(52) U.S. Cl.
CPC ..... *H01F 41/0206* (2013.01); *H01F 41/0233* (2013.01); *H01F 27/245* (2013.01); *H01F 27/25* (2013.01); *H01F 2003/005* (2013.01)

(58) Field of Classification Search
CPC .. H01F 2003/005; H01F 27/245; H01F 27/25; H01F 27/26
See application file for complete search history.

(56) References Cited

U.S. PATENT DOCUMENTS

| | | | | |
|---|---|---|---|---|
| 5,671,526 | A * | 9/1997 | Merlano | H01F 41/0233 29/609 |
| 6,369,687 | B1 * | 4/2002 | Akita | H02K 1/148 310/216.011 |
| 7,336,014 | B2 * | 2/2008 | Lee | H02K 1/148 310/216.001 |
| 7,755,242 | B2 * | 7/2010 | Jun | H02K 1/146 310/186 |
| 8,205,322 | B2 * | 6/2012 | Mitsui | H02K 1/148 29/596 |
| 9,099,897 | B2 * | 8/2015 | Neuenschwander | B23P 11/005 |
| 9,825,512 | B2 * | 11/2017 | Shijo | H02K 1/148 |
| 2001/0013168 | A1 * | 8/2001 | Asao | H02K 1/16 29/596 |
| 2005/0109178 | A1 * | 5/2005 | Oba | B21D 28/06 83/50 |
| 2005/0194858 | A1 * | 9/2005 | Ahn | D06F 37/304 310/216.114 |
| 2007/0214632 | A1 * | 9/2007 | Kojima | H02K 15/022 29/596 |
| 2009/0026873 | A1 | 1/2009 | Matsuo et al. | |
| 2011/0016929 | A1 | 1/2011 | Ahn | |
| 2013/0169104 | A1 | 7/2013 | Jang et al. | |
| 2015/0020375 | A1 * | 1/2015 | Toyomaru | H02K 15/026 29/596 |

FOREIGN PATENT DOCUMENTS

| | | | |
|---|---|---|---|
| CN | 102857066 | | 1/2013 |
| CN | 104300744 | | 1/2015 |
| JP | 7-135755 | | 5/1995 |
| JP | 7-101976 | | 11/1995 |
| JP | 10-201146 | | 7/1998 |
| JP | 2003-164080 | | 6/2003 |
| JP | 2003-235187 | A | 8/2003 |
| JP | 3782533 | | 6/2006 |
| JP | 4330420 | | 9/2009 |
| JP | 2011-244689 | | 12/2011 |
| JP | 2014-236597 | A | 12/2014 |
| JP | 2015-149894 | A | 8/2015 |
| JP | 2015-167454 | A | 9/2015 |
| WO | 86/02501 | | 4/1986 |
| WO | 2015/111096 | A1 | 7/2015 |

OTHER PUBLICATIONS

Japan Official Action recited in JP Application No. 2016-057136 dated Oct. 23, 2019.
Japan Office Action issued in JP 2016-057136 and English translation thereof, dated Jan. 14, 2020.

* cited by examiner

METHOD FOR MANUFACTURING LAMINATED IRON CORE AND APPARATUS FOR MANUFACTURING LAMINATED IRON CORE

CROSS REFERENCE TO RELATED APPLICATION

This application is based upon and claims the benefit of priority of Japanese Patent Application No. 2016-057136 filed on Mar. 22, 2016, the contents of which are incorporated herein by reference in its entirety.

BACKGROUND OF THE INVENTION

1. Field of the Invention

The present invention relates to a method for manufacturing a laminated iron core formed by blanking iron core pieces from a strip-shaped workpiece and laminating the iron core pieces, and an apparatus for manufacturing the laminated iron core.

2. Description of the Related Art

A method for manufacturing a laminated iron core includes, for example, the following methods (A) to (C).

Method (A): The method for laminating linear strip-shaped iron core pieces (by one wind) blanked and formed from a strip-shaped workpiece by a die unit and forming a strip-shaped laminated iron core and annularly folding this strip-shaped laminated iron core and forming a laminated iron core (see Japanese Patent No. 3782533 as Patent Literature 1).

Method (B): The method for laminating while annularly winding linear strip-shaped iron core pieces blanked and formed from a strip-shaped workpiece by a die unit and forming a laminated iron core (see JP-B-7-101976 as Patent Literature 2).

Method (C): The method for annularly arranging a plurality of divided laminated iron cores in which divided iron core pieces (divided core pieces) blanked and formed from a strip-shaped workpiece by a die unit are laminated to form a laminated iron core.

In those cases, yield (material yield) of the strip-shaped workpiece can be improved by blanking the strip-shaped iron core pieces of two rows in the methods (A) and (B) and iron core piece groups (hereinafter simply called the iron core piece groups) of two rows formed by linearly arranging divided yoke piece parts of the plurality of divided iron core pieces in the method (C) from the strip-shaped workpiece in a layout having a state in which a magnetic pole piece part of the other row is arranged and opposed between adjacent magnetic pole piece parts (slot) of one row, that is, the magnetic pole piece parts of the rows are mated.

At this time, in order to maximize the yield of the strip-shaped workpiece, it is necessary to previously blank a front end (for example, the inside diameter side) of the magnetic pole piece part, for example, under the influence of dimension accuracy or the restrictions of arrangement of the die unit in the case of attempting to bring positions of the opposed strip-shaped iron core pieces or the opposed iron core piece groups of the two rows nearer.

As a method for previously blanking the front end of this magnetic pole piece part, for example, Patent Literature 2 or JP-A-2003-164080 as Patent Literature 3 mentions that the front ends of the magnetic pole piece parts of the strip-shaped iron core pieces or the iron core piece groups of the two rows are simultaneously blanked in consideration of, for example, a balance of blanking or a decrease in a blanking step.

Also, Patent Literature 2 mentions that back surfaces (for example, the outside diameter side) of yoke piece parts of two rows are simultaneously blanked in a different step.

In addition, in the method (A), a strip-shaped iron core piece can be obtained from a strip-shaped workpiece by blanking all the back surface of a yoke piece part in a blanking step as described in Patent Literature 3. Particularly, for example, when blanking requires a high load for a long strip-shaped iron core piece, before the blanking step, a part of the back surface of the yoke piece part is slit and in the blanking step, a gap between the slits of the back surfaces is blanked and thereby, a press load in one step can be decreased. Also in this case, the method for simultaneously blanking the front ends of the magnetic pole piece parts of the strip-shaped iron core pieces in the same step and simultaneously blanking the slits of the back surfaces of the yoke piece parts in a different step is adopted.

Patent Literature 1: Japanese Patent No. 3782533
Patent Literature 2: JP-B-7-101976
Patent Literature 3: JP-A-2003-164080

SUMMARY OF THE INVENTION

A dimension S ranging from a front end of a magnetic pole piece part 92 to a back surface of a yoke piece part 93 becomes important in blanking of strip-shaped iron core pieces 90, 91 (similarly, iron core piece groups) of two rows shown in FIG. 4. That is, a distance S from a blanked part 94 to a blanked part 95. As a result, the method for simultaneously blanking the front ends of the magnetic pole piece parts 92 of the strip-shaped iron core pieces 90, 91 of the two rows and simultaneously blanking the back surfaces of the yoke piece parts 93 in a different step has a problem that the dimension S does not become stable under the influence of, for example, expansion of the material. FIG. 4 shows the blanked part 94 of the front end side of the magnetic pole piece part 92, and the blanked part 95 of the back surface side of the yoke piece part 93.

This problem can be partly solved by adjusting a position of the die unit, but the dimensions S cannot be adjusted individually, with the result that even when the dimension of one row has no problem, it becomes necessary to adjust the dimension of the other row and consequently, it becomes difficult to perform high-accuracy blanking.

The present invention has been implemented in view of such circumstances, and a non-limited object of the present invention is to provide a method for manufacturing a laminated iron core capable of blanking an iron core piece from a strip-shaped workpiece with good workability and high accuracy.

An aspect of the present invention is to provide a method for manufacturing a laminated iron core, including: setting a blanking position on a strip-shaped workpiece for iron core pieces each including a yoke piece part having a linear shape and a magnetic pole piece part extending from the yoke piece part, such that a pair of iron core pieces are opposed each other and the magnetic pole piece part of one iron core piece is arranged between adjacent magnetic pole piece parts of the other iron core piece among the pair of iron core pieces; simultaneously blanking a front end side of the magnetic pole piece part and a back surface side of the yoke piece part of the one iron core piece from the strip-shaped workpiece before simultaneously blanking a front end side of the magnetic pole piece part and a back surface side of the yoke piece part of the other iron core piece from the strip-shaped workpiece; and blanking the iron core pieces from the strip-shaped workpiece.

The method for manufacturing the laminated iron core may further including laminating the iron core pieces to form the laminated iron core.

The method may be configured such that each of the iron core pieces is a linear strip-shaped iron core piece having the linear yoke piece part, and the laminated iron core is formed by laminating the linear strip-shaped iron core pieces and then annularly bending the linear strip-shaped iron core pieces.

The method may be configured such that each of the iron core pieces is a linear strip-shaped iron core piece having the linear yoke piece part, and the laminated iron core is formed by laminating while annularly winding the linear strip-shaped iron core pieces.

The method may be configured such that each of the iron core pieces includes a plurality of divided iron core pieces, and the laminated iron core is formed by annularly arranging a divided laminated iron core in which the plurality of divided iron core pieces are laminated.

The method may be configured such that the back surface side of the yoke piece part of each of the iron core pieces is blanked at a distance in a longitudinal direction of the yoke piece part to remain a non-blanked portion, and the non-blanked portion of the back surface side of the yoke piece part is blanked when separating each of the iron core pieces from the strip-shaped workpiece.

The method may be configured such that the pair of iron core pieces are sequentially blanked in a state where a longitudinal direction of each of the iron core pieces is aligned with a direction orthogonal to a conveyance direction of the strip-shaped workpiece.

The method may be configured such that the pair of iron core pieces are sequentially blanked in a state where a longitudinal direction of each of the iron core pieces is aligned with a direction different from a direction orthogonal to a conveyance direction of the strip-shaped workpiece.

The method for manufacturing the laminated iron core may further including blanking a portion between adjacent lateral parts of the magnetic pole piece part of the one iron core piece and the magnetic pole piece part of the other iron core piece before blanking the front end side of the magnetic pole piece part and the back surface side of the yoke piece part of each of the iron core pieces.

Another aspect of the present invention provides an apparatus for manufacturing a laminated iron core, which sets a blanking position on a strip-shaped workpiece for iron core pieces each including a yoke piece part having a linear shape and a magnetic pole piece part extending from the yoke piece part, such that a pair of iron core pieces are opposed each other and the magnetic pole piece part of one iron core piece is arranged between adjacent magnetic pole piece parts of the other iron core piece among the pair of iron core pieces, and blanks the iron core pieces from the strip-shaped workpiece, the apparatus including: a first die unit including a first die and a first punch which simultaneously blank a front end side of the magnetic pole piece part and a back surface side of the yoke piece part of the one iron core piece from the strip-shaped workpiece; and a second die unit including a second die and a second punch which simultaneously blank a front end side of the magnetic pole piece part and a back surface side of the yoke piece part of the other iron core piece, the second die unit being arranged in a downstream side from the first die unit.

The apparatus may be configured such that each of the first die and the first punch and each of the second die and the second punch blank the back surface side of the yoke piece part of each of the iron core pieces at a distance in a longitudinal direction of the yoke piece part to remain an non-blanked portion, and the apparatus further includes a third die unit including a third die and a third punch which blank the non-blanked portion left in the back surface side of the yoke piece part of each of the iron core pieces and separate each of the iron core pieces from the strip-shaped workpiece, the third die unit being arranged in a downstream side from the first die unit and the second die unit. For example, a part of the back surface side of the yoke piece part of each of the plurality iron core pieces is blanked such that a non-blanked portion remains.

The apparatus may further include a fourth die unit including a fourth die and a fourth punch which blank a portion between adjacent lateral parts of the magnetic pole piece part of the one iron core piece and the magnetic pole piece part of the other iron core piece, the fourth die unit being arranged in an upstream side from the first die unit and the second die unit.

The method and the apparatus for manufacturing the laminated iron core according to the aspects of the present invention simultaneously blank the front end side of the magnetic pole piece part and the back surface side of the yoke piece part of each of the iron core pieces in the case of blanking the pair of iron core pieces from the strip-shaped workpiece, with the result that accuracy of a dimension ranging from a front end of the magnetic pole piece part to a back surface of the yoke piece part can be improved. Also, in the case of blanking the iron core pieces, a position adjustment of the die unit can be made with respect to each of the iron core pieces, with the result that the position adjustment of the die unit is facilitated, and time consuming for the position adjustment can also be shortened.

Consequently, the iron core piece can be blanked from the strip-shaped workpiece with good workability and high accuracy.

Also, when the back surface side of the yoke piece part of each of the iron core pieces is blanked at the distance in the longitudinal direction of the yoke piece part, a press load in this blanking step can be decreased.

And, in the case of blanking the portion between the opposed lateral parts of the mated magnetic pole piece parts, this blanking causes expansion in the strip-shaped workpiece. As a result, by simultaneously blanking the front end side of the magnetic pole piece part and the back surface side of the yoke piece part of each of the iron core pieces after this blanking, the accuracy of the dimension ranging from the front end of the magnetic pole piece part to the back surface of the yoke piece part can be improved, with the result that, for example, the number of position adjustments of the die unit can be decreased.

DETAILED DESCRIPTION OF THE EXEMPLARY EMBODIMENTS

Subsequently, an embodiment of the present invention will be described with reference to the accompanying drawings, and the present invention will be understood.

Figure 1:
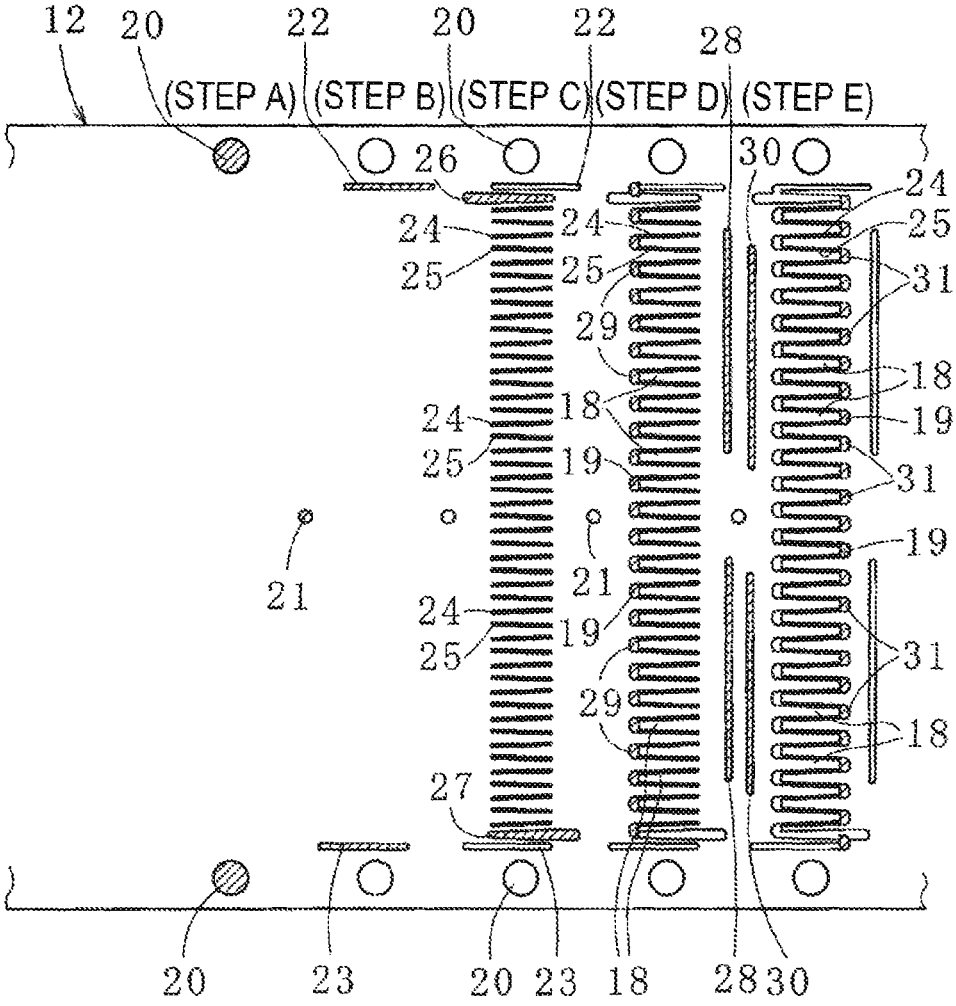
FIG. 1 is an explanatory diagram of a method for manufacturing a laminated iron core according to one embodiment of the present invention.

First, a laminated iron core manufactured by a method for manufacturing the laminated iron core according to one embodiment of the present invention will be described with reference to FIGS. 1 and 2.

The laminated iron core is a stator iron core (or simply referred to as stator) used in an inner rotor type.

This laminated iron core is formed by laminating a plurality of sets of a pair of (paired) iron core pieces 10, 11.

Each of the iron core pieces 10, 11 is blanked and formed from a strip-shaped workpiece (thin metal sheet) 12 made of, for example, an amorphous material or an electromagnetic steel plate with a thickness of about 0.10 to 1.2 mm. In FIGS. 1 and 2, the width (the length of each of the iron core pieces 10, 11 in a longitudinal direction) of the strip-shaped workpiece 12 is narrowed and described for convenience of description.

Concretely, each of the iron core pieces 10, 11 is a linear strip-shaped iron core piece having a linear yoke piece part 13 and a plurality of magnetic pole piece parts 18 extending from this yoke piece part 13. In the case of manufacturing the laminated iron core, the laminated iron core is formed by laminating a plurality of strip-shaped iron core pieces 10 and a plurality of strip-shaped iron core pieces 11 formed in linear shapes and then respectively annularly folding laminated bodies (strip-shaped laminated iron cores) of the strip-shaped iron core pieces 10 and the strip-shaped iron core pieces 11 and laminating the two laminated bodies. In addition, when the length of the iron core piece (strip-shaped iron core piece) is short, the laminated iron core can also be formed by respectively semi-circularly folding the laminated bodies (strip-shaped laminated iron cores) of the two strip-shaped iron core pieces and annularly arranging the laminated bodies.

Each of the iron core pieces 10, 11 is a piece blanked from one strip-shaped workpiece, but may be a piece blanked from plural (for example, two, or three or more) stacked strip-shaped workpieces.

Also, the radial width of the yoke piece part 13 is equal, but may be partially narrowed.

The iron core pieces 10 adjacent in a lamination direction and the iron core pieces 11 adjacent in the lamination direction are respectively mutually joined by caulking parts (caulking holes 34, 38, caulking projections 35, 39 described below), but can also be joined using any one or two or more of a resin (a thermosetting resin (for example, an epoxy resin) or a thermoplastic resin), an adhesive and welding.

In addition, the plurality of iron core pieces forming the laminated iron core can have the following configuration.

Each of the iron core pieces is a linear strip-shaped iron core piece having a linear yoke piece part and plural magnetic pole piece parts extending from this yoke piece part, and the length of the yoke piece part is long, and in the case of manufacturing the laminated iron core, the laminated iron core is formed by annularly winding and also laminating each of the strip-shaped iron core pieces formed in linear shapes.

In this case, each of the iron core pieces is blanked from the strip-shaped workpiece in a state where the longitudinal direction of each of the iron core pieces is aligned with a conveyance direction of the strip-shaped workpiece.

Figure 3:
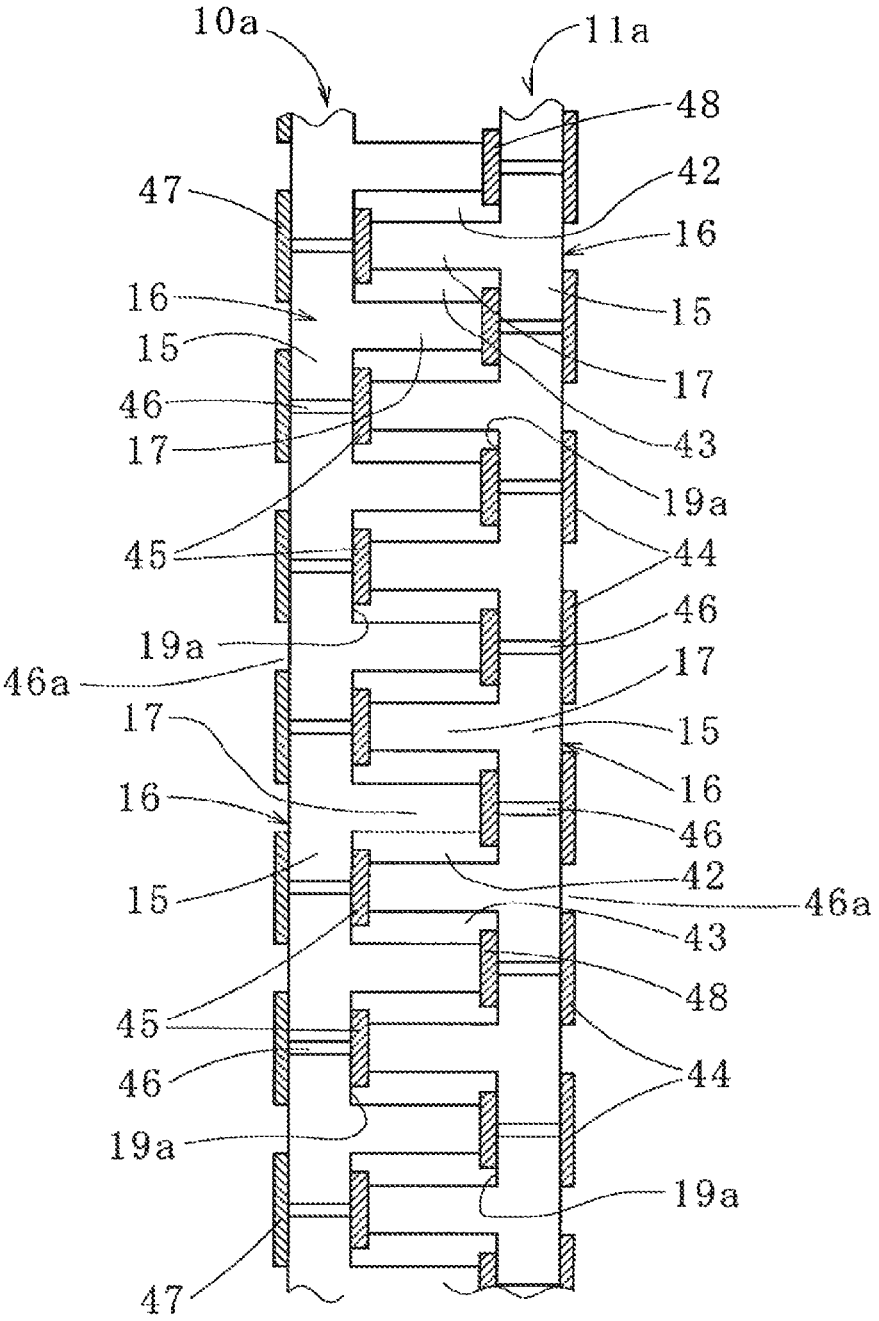
FIG. 3 is an explanatory diagram of a method for manufacturing a laminated iron core according to another embodiment of the present invention.
Figure 4:
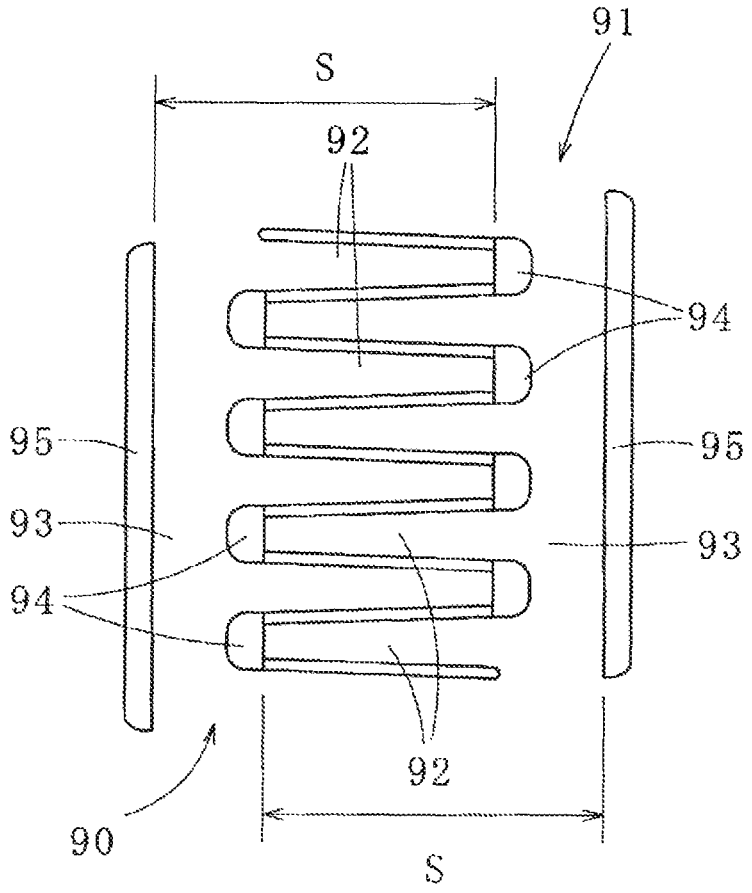
FIG. 4 is an explanatory diagram of a method for manufacturing a laminated iron core according to a related example.

Also, each of iron core pieces 10*a*, 11*a* shown in FIG. 3 as another embodiment includes a plurality of divided iron core pieces 16, and has discontinuous divided yoke piece parts 15 of the divided iron core pieces 16. In the case of manufacturing the laminated iron core, the laminated iron core is formed by annularly arranging plural divided laminated iron cores constructed by laminating the divided iron core pieces 16 (.

In addition, in each of the divided iron core pieces 16, one magnetic pole piece part 17 extends from one divided yoke piece part 15, but a plurality of magnetic pole piece parts may extend.

The laminated iron core formed by laminating the iron core pieces 10, 11 has an annular yoke part and a plurality of magnetic pole parts connected integrally to an inner peripheral side of this yoke part.

The yoke part and the magnetic pole parts are respectively formed of the laminated yoke piece parts 13 and the laminated magnetic pole piece parts 18 by laminating the plurality of iron core pieces 10, 11 having the yoke piece parts 13 and the plurality of magnetic pole piece parts 18. In addition, the magnetic pole piece part 18 is formed by blanking a slot 19 from the strip-shaped workpiece.

Figure 5:
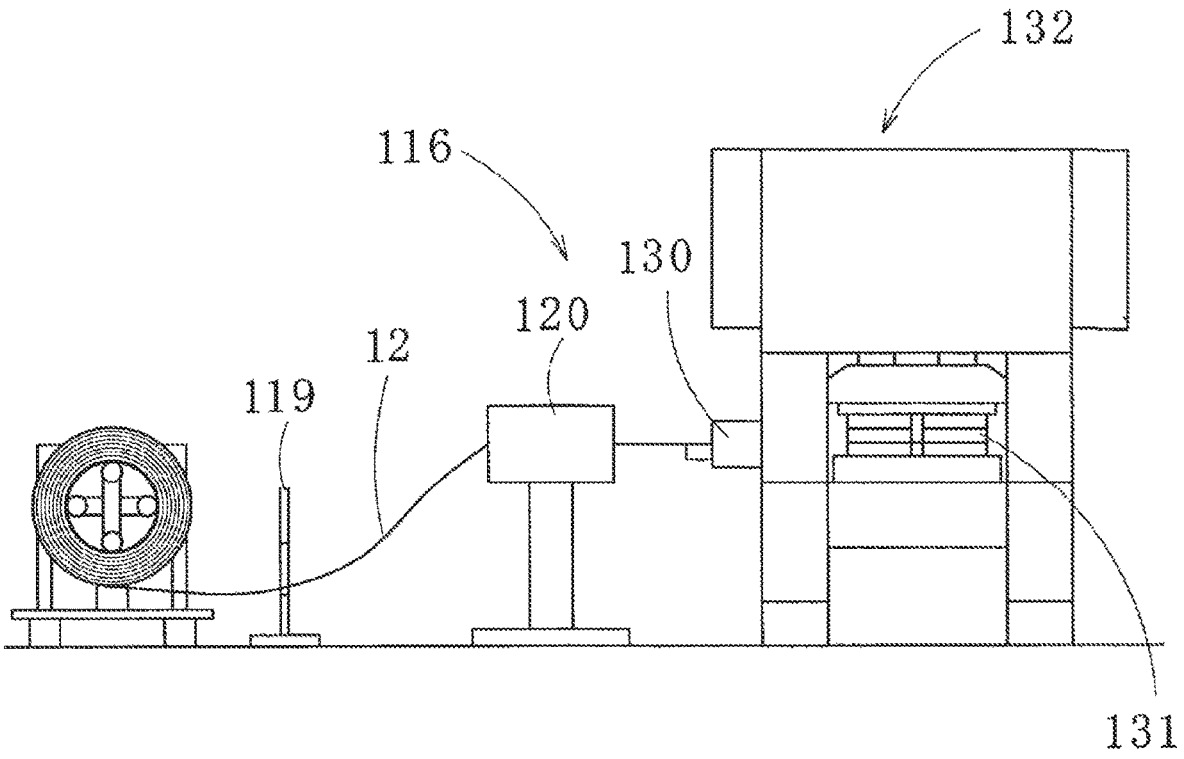
FIG. 5 is an schematic diagram of an apparatus for manufacturing a laminated iron core according to one embodiment of the present invention.

FIG. 5 shows an apparatus 132 for manufacturing the laminated iron core according to one embodiment of the present invention. For example, the strip-shaped workpiece 12 is sequentially fed from a winding storage through a drawing apparatus 119, a correction apparatus 120 and a feeding apparatus 130 toward the apparatus 132 for manufacturing the laminated iron core. In the apparatus 132 for manufacturing the laminated iron core, the strip-shaped workpiece 12 is punched and blanked to produce the iron core pieces 10, 11 by using dies and punches of die units 131.

Subsequently a method for manufacturing the laminated iron core according to one embodiment of the present invention will be described with reference to FIGS. 1 and 2.

The method for manufacturing the laminated iron core is a method for forming the laminated iron core by conveying the strip-shaped workpiece 12 with a thickness of about 0.10 to 1.2 mm at a predetermined pitch using the apparatus 132 for manufacturing the laminated iron core and also blanking a plurality of sets of paired iron core pieces 10, 11 and sequentially laminating the iron core pieces 10, 11. The method includes steps A to K. In addition, the die units 131 are respectively arranged in each of the steps A to K, and the apparatus 132 for manufacturing the laminated iron core includes those die units 131.

A blanking position on the strip-shaped workpiece 12 for the paired iron core pieces 10, 11 is set such that the yoke piece part 13 of each of the iron core pieces 10, 11 has a linear shape and the paired iron core pieces 10, 11 are opposed (opposed and arranged) and the magnetic pole piece part 18 of the other iron core piece 10 is mated and arranged between the adjacent magnetic pole piece parts 18 of one iron core piece 11.

In addition, a pair of the iron core pieces 10, 11 is sequentially blanked from the strip-shaped workpiece 12 in a state where the longitudinal direction of each of the iron core pieces 10, 11 is aligned with a direction (a width direction of the strip-shaped workpiece 12) orthogonal to the conveyance direction of the strip-shaped workpiece 12.

Hereinafter, detailed description will be made.

(Step A)

In the step A, pilot holes 20, 21 are blanked from the strip-shaped workpiece 12.

Accordingly, the pilot holes 20 are formed in both sides of the strip-shaped workpiece 12 in the width direction and the pilot holes 21 are formed in the center of the strip-shaped workpiece 12 in the width direction at predetermined pitches, respectively. In addition, it is unnecessary to form the pilot hole 21, or the plurality of pilot holes 21 can also be spaced in the width direction of the strip-shaped workpiece 12 according to the width of the strip-shaped workpiece 12.

(Step B)

In the step B, narrow slits 22, 23 having a longitudinal direction same as the conveyance direction of the strip-shaped workpiece 12 are formed in both sides (insides from the pilot holes 20) of the strip-shaped workpiece 12 in the width direction.

Accordingly, both sides of the strip-shaped workpiece 12 in the width direction are formed with one ends of the iron core pieces 10, 11 in the longitudinal direction.

(Step C)

In the step C, a region (a portion between the slits 22, 23, the same applies hereinafter) for forming the iron core pieces 10, 11 of the strip-shaped workpiece 12 is formed with plural paired slits 24, 25 at predetermined pitches in the width direction of the strip-shaped workpiece 12. This pair of slits 24, 25 is formed by blanking a portion between adjacent lateral parts of the magnetic pole piece part 18 of one iron core piece 11 and the magnetic pole piece part 18 of the other iron core piece 10 by a fourth die unit (not shown). In addition, the fourth die unit includes a fourth die and a fourth punch corresponding to contour shapes of the slits 24, 25.

Accordingly, a side surface of the magnetic pole piece part 18 of each of the iron core pieces 10, 11 is formed in the width direction of the strip-shaped workpiece 12.

Also, narrow slits 26, 27 are formed between the slits 22, 24 and between the slits 23, 24, respectively.

Accordingly, both sides of the strip-shaped workpiece 12 in the width direction are formed with the other ends of the iron core pieces 10, 11 in the longitudinal direction.

(Step D)

In the step D, the region for forming the iron core pieces 10, 11 of the strip-shaped workpiece 12 is formed with a plurality of narrow slits 28 and blanked parts 29 in the width direction of the strip-shaped workpiece 12. The plurality of slits 28 and blanked parts 29 are formed by simultaneously blanking the front end side of the magnetic pole piece part 18 and the back surface side of the yoke piece part 13 of the iron core piece 11 by a first die unit (not shown). In addition, the first die unit includes a first die and a first punch corresponding to contour shapes of the slits 28 and the blanked parts 29.

Here, the back surface side of the yoke piece part 13 is blanked at a distance in a longitudinal direction of the yoke piece part 13. In addition, the slit 28 formed by this blanking has the length ranging to a plurality of (about nine herein) magnetic pole piece parts 18.

Accordingly, a back surface of the yoke piece part 13 of the iron core piece 11 is partially formed.

Also, the front end side of the magnetic pole piece part 18 of the iron core piece 11 is blanked at a predetermined pitch in the width direction of the strip-shaped workpiece 12 so as to join the ends of a pair of the slits 24, 25 in the upstream side of the conveyance direction.

Accordingly, a front end surface of the magnetic pole piece part 18 of the iron core piece 11 is formed and also, a slot 19 of the iron core piece 10 is formed.

(Step E)

In the step E, the region for forming the iron core pieces 10, 11 of the strip-shaped workpiece 12 is formed with a plurality of narrow slits 30 and blanked parts 31 in the width direction of the strip-shaped workpiece 12. The plurality of slits 30 and blanked parts 31 are formed by simultaneously blanking the front end side of the magnetic pole piece part 18 and the back surface side of the yoke piece part 13 of the iron core piece 10 by a second die unit (not shown) arranged in the side downstream from the first die unit. In addition, the second die unit includes a second die and a second punch corresponding to contour shapes of the slits 30 and the blanked parts 31.

In addition, blanking of the back surface side of the yoke piece part 13 of the iron core piece 10 and blanking of the front end side of the magnetic pole piece part 18 are similar to those of the step D described above.

Accordingly, a back surface of the yoke piece part 13 of the iron core piece 10 is partially formed and also, a front end surface of the magnetic pole piece part 18 of the iron core piece 10 and a slot 19 of the iron core piece 11 are formed.

By arranging the fourth die unit in the upstream side from the first and second die units as described above, the portion between the adjacent lateral parts of the mated magnetic pole piece parts 18 of the iron core pieces 10, 11 can be blanked before the front end sides of the magnetic pole piece parts 18 and the back surface sides of the yoke piece parts 13 of the iron core pieces 10, 11 are blanked.

Accordingly, the influence of expansion of the strip-shaped workpiece caused by blanking the portion between the adjacent lateral parts of the magnetic pole piece parts 18 on accuracy of a dimension ranging from the front end of the magnetic pole piece part 18 to the back surface of the yoke piece part 13 can be decreased.

(Step F)

In the step F, pilot holes 32, 33 are blanked from the strip-shaped workpiece 12.

The pilot holes 32 are formed between the pilot holes 20 adjacent in the conveyance direction formed in both sides of the strip-shaped workpiece 12 in the width direction in the step A described above.

Also, the pilot hole 33 is formed between (in the vicinity of the pilot hole 21 formed in the step A described above herein) a pair of the iron core pieces 10, 11 and a pair of the iron core pieces 10, 11 adjacent in the conveyance direction of the strip-shaped workpiece 12.

Accordingly, the accuracy of the dimension in the case of blanking can be made higher.

Simultaneously, the region for forming the iron core piece 11 of the strip-shaped workpiece 12 is formed with a caulking hole 34 in the iron core piece 11 used as the lowermost layer of a laminated body. In addition, the caulking hole 34 may be formed in a different step.

(Step G)

In the step G, the region for forming the iron core piece 11 of the strip-shaped workpiece 12 is formed with caulking projections 35 in the iron core pieces 11 used as layers other than the lowermost layer of the laminated body.

(Step H)

In the step H, non-blanked parts 36, 37 left in the back surface side of the yoke piece part 13 in the case of forming the slit 28 in the step D described above are blanked. The non-blanked parts 36, 37 can be blanked by a third die unit (not shown) which is arranged in the downstream side from the first and second die units and includes a third die and a third punch.

Accordingly, the iron core pieces 11 are separated from the strip-shaped workpiece 12 and also, the plurality of iron core pieces 11 formed with the caulking projections 35 can be sequentially caulked and laminated on the iron core piece 11 formed with the caulking hole 34 (the step of laminating the plurality of iron core pieces 11).

(Step I)

In the step I, the region for forming the iron core piece 10 of the strip-shaped workpiece 12 is formed with a caulking hole 38 in the iron core piece 10 used as the lowermost layer of a laminated body.

(Step J)

In the step J, the region for forming the iron core piece 10 of the strip-shaped workpiece 12 is formed with caulking projections 39 in the iron core pieces 10 used as layers other than the lowermost layer of the laminated body.

(Step K)

In this step, non-blanked parts 40, 41 left in the back surface side of the yoke piece part 13 in the case of forming the slit 30 in the step E described above are blanked. The non-blanked parts 40, 41 can be blanked by a die unit (not shown) with a configuration substantially similar to that of the third die unit used in the step H described above.

Accordingly, the iron core pieces 10 are separated from the strip-shaped workpiece 12 and also, the plurality of iron core pieces 10 formed with the caulking projections 39 can be sequentially caulked and laminated on the iron core piece 10 formed with the caulking hole 38 (the step of laminating the plurality of iron core pieces 10).

The laminated iron core can be manufactured by respectively annularly folding the laminated bodies (strip-shaped laminated iron cores) of the strip-shaped iron core pieces 10 and the strip-shaped iron core pieces 11 manufactured by the method described above and laminating the two laminated bodies.

In addition, when each of the iron core pieces 10*a*, 11*a* includes plural divided iron core pieces 16 and has discontinuous divided yoke piece parts 15 of the divided iron core pieces 16 as shown in FIG. 3, the iron core pieces 10*a*, 11*a* are blanked from a strip-shaped workpiece by a method substantially similar to the method described above, with the result that steps C' to E' corresponding to the steps C to E described above will herein be described briefly. In addition, FIG. 3 describes a state where the adjacent divided iron core pieces 16 constructing each of the iron core pieces 10*a*, 11*a* are separated, but the adjacent divided iron core pieces 16 may abut.

(Step C')

In the step C', a region for forming the iron core pieces 10*a*, 11*a* of the strip-shaped workpiece is formed with a plurality of paired slits 42, 43 at predetermined pitches in a width direction of the strip-shaped workpiece. This pair of slits 42, 43 is formed by blanking a portion between adjacent lateral parts of a magnetic pole piece part 17 of one iron core piece 11*a* and a magnetic pole piece part 17 of the other iron core piece 10*a*.

Accordingly, a side surface of the magnetic pole piece part 17 of each of the iron core pieces 10*a*, 11*a* is formed in the width direction of the strip-shaped workpiece.

(Step D')

In the step D', the region for forming the iron core pieces 10*a*, 11*a* of the strip-shaped workpiece is formed with a plurality of narrow slits 44 and blanked parts 45 in the width direction of the strip-shaped workpiece. The plurality of slits 44 and blanked parts 45 are formed by simultaneously blanking the front end sides of the magnetic pole piece parts 17 and the back surface sides of the plurality of divided yoke piece parts 15 of the iron core piece 11*a*.

Here, the back surface side of the divided yoke piece part 15 is blanked at a distance 46*a* in a longitudinal direction of the divided yoke piece part 15. In addition, the slit 44 formed by this blanking has the length ranging to the adjacent magnetic pole piece parts 17.

Accordingly, a back surface of the divided yoke piece part 15 of the iron core piece 11*a* is partially formed.

Also, the front end side of the magnetic pole piece part 17 is blanked at a predetermined pitch in the width direction of the strip-shaped workpiece so as to join the ends of a pair of the slits 42, 43 in the upstream side of the conveyance direction.

Accordingly, a front end surface of the magnetic pole piece part 17 of the iron core piece 11*a* is formed and also, a slot 19*a* of the iron core piece 10*a* is formed.

(Step E')

In the step E', the region for forming the iron core pieces 10*a*, 11*a* of the strip-shaped workpiece is formed with a plurality of narrow slits 47 and blanked parts 48 in the width direction of the strip-shaped workpiece. The plurality of slits 47 and blanked parts 48 are formed by simultaneously blanking the front end sides of the magnetic pole piece part 17 and the back surface sides of the plurality of divided yoke piece parts 15 of the iron core piece 10*a*.

In addition, blanking of the back surface side of the divided yoke piece part 15 and blanking of the front end side of the magnetic pole piece part 17 are similar to those of the step D' described above.

Accordingly, a back surface of the divided yoke piece part 15 of the iron core piece 10*a* is partially formed and also, a front end surface of the magnetic pole piece part 17 of the iron core piece 10*a* and a slot 19*a* of the iron core piece 11*a* are formed.

Figure 2:
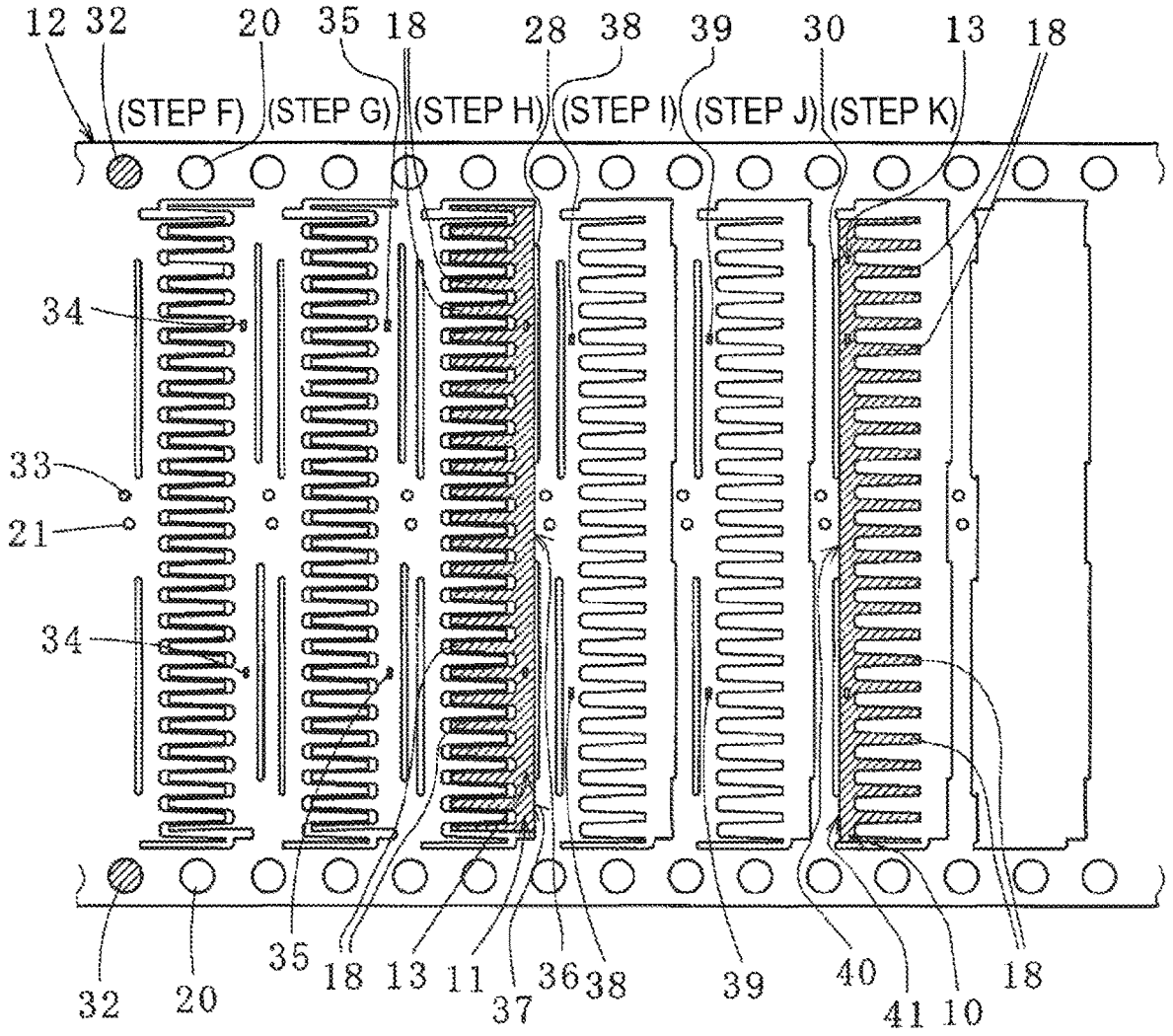
FIG. 2 is an explanatory diagram of a method for manufacturing the laminated iron core.

In addition, a gap 46 between the adjacent divided yoke piece parts 15 could be blanked before steps corresponding to the step H and the step K of FIG. 2.

Also, when the gap 46 is absent, that is, the adjacent divided iron core pieces 16 abut, the adjacent divided yoke piece parts 15 are cut. This cutting method includes, for example, a method for depressing one divided yoke piece part 15 against the other divided yoke piece part 15 and cutting the divided yoke piece parts 15 and then pressing back and returning to the same plane. In addition, this cutting is preferably made in a step after (downstream from) the step E'.

As described above, the iron core piece can be blanked from the strip-shaped workpiece with good workability and high accuracy by using the method and the apparatus for manufacturing the laminated iron core according to the aspects of the present invention.

The present invention has been described above with reference to the embodiment, but the present invention is not limited to the configuration described in the embodiment described above, and also includes other embodiments and modified examples contemplated within the scope of the matter described in the claims. For example, the case of constructing the method and the apparatus for manufacturing the laminated iron core of the present invention by combining a part or all of the respective embodiments and modified examples described above is also included in the scope of right of the present invention.

The embodiment described above describes the case of applying the method and the apparatus for manufacturing the laminated iron core of the present invention to manufacture of the stator laminated iron core of the inner rotor type in which the rotor laminated iron core is arranged inside the stator laminated iron core so as to have a gap, but the method and the apparatus can also be applied to manufacture of a stator laminated iron core of an outer rotor type in which a rotor laminated iron core is arranged outside the stator laminated iron core so as to have a gap, and can also be applied to manufacture of a rotor laminated iron core.

In the embodiment described above, a pair of the iron core pieces is blanked from the strip-shaped workpiece in the state in which the longitudinal direction of each of the iron core pieces is aligned with the direction orthogonal to the conveyance direction of the strip-shaped workpiece. However, the iron core pieces can also be blanked in a state in which the longitudinal direction of each of the iron core pieces is aligned with a direction different from the direction orthogonal to the conveyance direction of the strip-shaped workpiece, for example, the conveyance direction of the strip-shaped workpiece or an oblique direction with respect to the conveyance direction (for example, see Japanese Patent No. 4330420).

Also, the steps other than the steps D (D') and the steps E (E') can be combined freely, and can be divided into a plurality of steps.

Reference signs are listed as follows:

10, 10*a*. 11, 11*a*: IRON CORE PIECE
12: STRIP-SHAPED WORKPIECE
13: YOKE PIECE PART
15: DIVIDED YOKE PIECE PART
16: DIVIDED IRON CORE PIECE
17, 18: MAGNETIC POLE PIECE PART
19, 19*a*: SLOT
20, 21: PILOT HOLE
22 to 28: SLIT
29: BLANKED PART
30: SLIT
31: BLANKED PART
32, 33: PILOT HOLE
34: CAULKING HOLE
35: CAULKING PROJECTION
36, 37: NON-BLANKED PART
38: CAULKING HOLE
39: CAULKING PROJECTION
40, 41: NON-BLANKED PART
42 to 44: SLIT
45: BLANKED PART
46: GAP
46*a*: DISTANCE
47: SLIT
48: BLANKED PART
119: DRAWING APPARATUS
120: CORRECTION APPARATUS
130: FEEDING APPARATUS
131: DIE UNIT
132: APPARATUS FOR MANUFACTURING LAMINATED IRON CORE

What is claimed is:

1. A method for manufacturing a laminated iron core, comprising:

setting a blanking position on a sheet of workpiece material for a plurality of iron core pieces, and each of the plurality of iron core pieces including a yoke piece part having a linear shape and magnetic pole piece parts extending from the yoke piece part, such that a pair of iron core pieces, among the plurality of iron core pieces, are located opposed to each other and respective ones of the magnetic pole piece parts of a first iron core piece, from the pair of iron core pieces, are arranged between respective adjacent ones of magnetic pole piece parts of a second iron core piece, from the pair of iron core pieces;

simultaneously blanking a front end side of the magnetic pole piece parts and a back surface side of the yoke piece part of the first iron core piece such that the first iron core piece is partially blanked from the sheet of workpiece material before simultaneously blanking a front end side of the magnetic pole piece parts and a back surface side of the yoke piece part of the second iron core piece such that the second iron core piece is partially blanked from the sheet of workpiece material; and then blanking the plurality of iron core pieces, which includes the first iron core piece and the second iron core piece, such that the plurality of iron core pieces is completely separated from the sheet of workpiece material; after blanking, laminating two or more of the plurality of iron core pieces together to form the laminated iron core.

2. The method for manufacturing the laminated iron core according to claim 1, wherein each of the plurality of iron core pieces is an elongated iron core piece having the linear yoke piece part, and the laminated iron core is formed by laminating the elongated iron core pieces and then annularly bending the elongated iron core pieces.

3. The method for manufacturing the laminated iron core according to claim 1, wherein each of the plurality of iron core pieces is an elongated iron core piece having the linear yoke piece part, and the laminated iron core is formed by laminating while annularly winding the elongated iron core pieces.

4. The method for manufacturing the laminated iron core according to claim 1, wherein each of the plurality of iron core pieces includes a plurality of divided iron core pieces, and the laminated iron core is formed by laminating and arranging the plurality of divided iron core pieces annularly.

5. The method for manufacturing the laminated iron core according to claim 1, wherein a part of the back surface side of the yoke piece part of each of the plurality of iron core pieces is blanked such that a non-blanked portion remains, and the remaining non-blanked portion of the back surface side of the yoke piece part is subsequently blanked when completely separating each of the plurality of iron core pieces from the workpiece.

6. The method for manufacturing the laminated iron core according to claim 1, wherein the pair of iron core pieces are sequentially blanked in a state where a longitudinal direction of each of the plurality of iron core pieces is aligned with a direction orthogonal to a conveyance direction of the sheet of workpiece material.

7. The method for manufacturing the laminated iron core according to claim 1, wherein the pair of iron core pieces are sequentially blanked in a state where a longitudinal direction of each of the plurality of iron core pieces is aligned with a direction different from a direction orthogonal to a conveyance direction of the sheet of workpiece material.

8. The method for manufacturing the laminated iron core according to claim 1, further comprising:

blanking (i) a portion between lateral parts of the magnetic pole piece parts of the first iron core piece, which are adjacent each other and (ii) blanking a portion between lateral parts of the magnetic pole piece parts of the second iron core piece, which are adjacent each other, before blanking the front end side of the magnetic pole piece parts and the back surface side of the yoke piece part of each of the plurality of iron core pieces.

* * * * *